US005517077A

United States Patent [19]

Bright et al.

[11] Patent Number: 5,517,077

[45] Date of Patent: May 14, 1996

[54] ION IMPLANTATION HAVING INCREASED SOURCE LIFETIME

[75] Inventors: Nicholas Bright, Saratoga, Calif.; Paul A. Burfield, Crawley, England; John Pontefract, Uckfield, England; Bernard F. Harrison, Cothorne, England; Peter Meares, Holt, England; David R. Burgin, Grenoble, France; Andrew S. Devaney, Wivelsfield Green; Peter T. Kindersley, Horsham, both of England

[73] Assignee: Applied Materials, Inc., Santa Clara, Calif.

[21] Appl. No.: 105,522

[22] Filed: Aug. 11, 1993

Related U.S. Application Data

[60] Division of Ser. No. 898,854, Jun. 15, 1992, Pat. No. 5,262,652, which is a continuation-in-part of Ser. No. 699, 874, May 14, 1991, abandoned.

[51] Int. Cl.[6] ..... H01J 27/08; H05H 1/48

[52] U.S. Cl. ..... 313/359.1; 313/231.41; 313/231.71; 313/341; 313/240; 313/333; 315/111.81; 250/426; 250/423 R

[58] Field of Search ..... 313/359.1, 231.41, 313/311, 240, 242, 333, 341, 231.71; 315/111.81, 111.21; 250/423 R, 426, 427

[56] References Cited

U.S. PATENT DOCUMENTS

| | | | |
|---|---|---|---|
| 3,013,169 | 12/1961 | Gungle et al. | 313/240 X |
| 3,705,320 | 12/1972 | Freeman | 313/63 |
| 4,017,403 | 4/1977 | Freeman | 250/492 A |
| 4,135,093 | 1/1979 | Kim | 250/423 R |
| 4,383,177 | 5/1983 | Keller et al. | 259/423 R |
| 4,447,773 | 5/1984 | Aston | 328/233 |
| 4,578,589 | 3/1986 | Aitken | 250/492.2 |
| 4,719,355 | 1/1988 | Meyers et al. | 250/425 |
| 4,754,200 | 6/1988 | Plumb et al. | 315/11.81 |
| 4,792,687 | 12/1988 | Mobley | 250/423 R |
| 4,891,551 | 1/1990 | Will et al. | 313/240 X |
| 5,004,949 | 4/1991 | Latassa et al. | 313/240 X |
| 5,144,143 | 9/1992 | Raspagliesi et al. | 250/426 |
| 5,162,699 | 11/1992 | Tokoro et al. | 315/111.81 |

OTHER PUBLICATIONS

Freeman, "A New Ion Source . . . " Nuclear Instrum. & Methods (1963) pp. 306–316.

Aston, "High Efficiency Ion Beam . . . ", Rev. Sc. Instru. 52(9) Sep. 1981, pp. 1325–1327.

Aitken, "The Design Philosophy . . . ", Nuclear Instrum. & Methods, (1976) pp. 125–134.

*Primary Examiner*—Walter E. Snow
*Assistant Examiner*—Ashok Patel
*Attorney, Agent, or Firm*—Birgit E. Morris

[57] ABSTRACT

Ion implantation equipment is modified so as to provide filament reflectors to a filament inside of an arc chamber, and to remove the electrical insulators for the filament outside of the arc chamber and providing a means of shielding, thereby reducing the formation of a conductive layer on said insulators and greatly extending the lifetime and reducing downtime of the equipment. The efficiency of the equipment is further enhanced by means of an interchangeable liner for the arc chamber that increases the wall temperature of the arc chamber and thus the electron temperature. The use of tungsten parts inside the arc chamber, obtained either by making the arc chamber itself or portions thereof of tungsten, particularly the front plate having the exit aperture for the ion beam, or by inserting a removable tungsten liner therein, decreases contamination of the ion beam. Serviceability of the arc chamber is improved by means of a unitary clamp that separately grips both the filament and filament reflectors. This clamp can also advantageously be made of tungsten.

17 Claims, 7 Drawing Sheets

ION IMPLANTATION HAVING INCREASED SOURCE LIFETIME

This is a division of application Ser. No. 07/898,854 filed Jun. 15, 1992, now U.S. Pat. No. 5,262,652 issued Nov. 16, 1993 which is a continuation-in-part of U.S. application Ser. No. 07/699,874 filed May 14, 1991, now abandoned.

This invention relates to improved systems and methods for implanting preselected ions into a target. More particularly, this invention relates to apparatus for ion implanting preselected ions into a target having improved ion source lifetime and reduced ion beam contamination.

BACKGROUND OF THE INVENTION

In the manufacture of semiconductor devices, various regions of a semiconductor wafer are modified by diffusing or implanting positive or negative ions (dopants), such as boron, phosphorus, arsenic, antimony and the like, into the body of the wafer to produce regions having varying conductivity. As the size of semiconductor devices becomes smaller, as in the manufacture of LSI and VLSI devices, the devices and interconnections between them are set closer together. This results in more efficient use of the wafer and increased speed of operation of the devices, but concomitantly requires more precision in the placement of the conductivity modifiers. Improvements in the equipment used to carry out the doping have also been made.

Diffusion, which involves depositing conductivity modifying ions on the surface of a wafer and driving them into the body of the wafer with heat, has limitations in establishing tight control of geometries because the diffusion process drives ions into a wafer both laterally and perpendicularly. Thus ion implantation, which can drive ions into a wafer in an anisotropic manner, has become the doping method of choice for the manufacture of modern devices.

Various ion implanters are known, using several types of ion sources. An ion beam of a preselected chemical species is generated by means of a current applied to a filament within an ion source chamber, also fitted with a power supply, ion precursor gas feeds and controls. The ions are extracted through an aperture in the ion source chamber by means of a potential between the source chamber, which is positive, and extraction means. Allied acceleration systems, a magnetic analysis stage that separates the desired ions from unwanted ions on the basis of mass and focuses the ion beam, and a post acceleration stage that ensures delivery of the required ions at the required beam current level to the target or substrate wafer to be implanted, complete the system. The size and intensity of the generated ion beam can be tailored by system design and operating conditions; for example, the current applied to the filament can be varied to regulate the intensity of the ion beam emitted from the ion source chamber. State of the art ion implantation systems have been described by Plumb et al in U.S. Pat. No. 4,754,200 and by Aitken in U.S. Pat. No. 4,578,589, both incorporated herein by reference.

The most common type of ion source used commercially is known as a Freeman source. In the Freeman source, the filament, or cathode, is a straight rod that can be made of tungsten or tungsten alloy, or other known source material such as iridium, that is passed into an arc chamber whose walls are the anode.

The arc chamber itself is fitted with an exit aperture, with means for feeding in the desired gaseous ion precursors for the desired ions; with vacuum means; with means for heating the cathode to about 2000° K. up to about 2800° K. so that it will emit electrons; with a magnet that applies a magnetic field parallel to the filament to increase the electron path length; and with a power supply connected from the filament to the arc chamber.

When power is fed to the filament, the filament temperature increases until it emits electrons that bombard the precursor gas molecules, breaking up the gas molecules so that a plasma is formed containing the electrons and various ions. The ions are emitted from the source chamber through the exit aperture and selectively passed to the target.

The filament is insulated with electrical insulators that also act to support the filament. The insulators are made of high temperature ceramic materials, such as alumina or boron nitride, that will withstand high temperatures and the corrosive atmosphere generated by precursor gas species such as $BF_3$ or $SiF_4$, and fragments thereof. The insulators, it turns out, severely limit the lifetime of the ion source. Although the exact number and type of ions that are generated in the source chamber are not known with certainty, various ions generated in the chamber can react both with the graphite or molybdenum walls of the chamber and with other ions in the chamber to form reaction products that deposit on the surface of the insulator, forming a conductive coating. For example, when $BF_3$ is fed to the source chamber, chemical reactions with carbon from the graphite chamber walls and fluorine produce various carbon-fluoride species, such as CF and $CF_2$, which further react to form a fine dust that coats the insulator. Conductive compounds may also be generated from other parts of the source chamber. Even a very thin conductive coating short circuits the arc supply and interferes with the stability of the ion beam emitted from the source chamber, eventually rendering it unusable. At this point the chamber must be cleaned and the insulators and filament reconditioned or replaced. This is the most common and most frequent cause of downtime for ion implanters.

Some prior art workers have made suggestions to prevent formation of this conductive coating on the insulators. For example, it is known to change the geometry of the electrical insulators in an arc chamber to reduce formation of the coating, but this does not greatly extend the lifetime of the unit. Others have suggested shields for the insulators to protect them from forming a conductive coating; however, the shields themselves add instabilities to the system. A cleaning discharge to etch off the coating inside the chamber has also been tried, but with mixed success since still other ions are formed during etching that can introduce other instabilities and undesired ions within the chamber.

Thus a method of reducing or eliminating the formation of a conductive coating on the filament insulators, thereby extending the time between the need for servicing the arc chamber and reducing down time for the ion implanter, would be highly desirable; further, reducing contamination of the ion beam and improving the ionization efficiency would all contribute to the economies of ion implantation.

SUMMARY OF THE INVENTION

The ion beam apparatus of the invention has the electrical insulators for the filament situate outside of the arc chamber and mounted onto the source body where it can continue its function of insulating the filament, but, because the insulator is no longer situate in the arc chamber itself and therefore exposed to ionic species, it does not rapidly build up a conductive coating. Thus the lifetime of the ion source is greatly extended over conventional ion beam apparatus.

To further protect the filament insulators from building up a conductive coating from the gases in the arc chamber, the insulators can be protected further from the chamber gases by means of at least one of a shield and an inert gas bleed.

The contamination of the ion beam with contaminants from the materials in the arc chamber is reduced by making the arc chamber itself, portions thereof, or a removable liner therefor, made of tungsten.

The ionization efficiency of the arc chamber is enhanced by using a removable refractory liner so that heat generated in the chamber when the filament is powered is transferred to the chamber walls by radiation, increasing the electron temperature during operation.

DETAILED DESCRIPTION OF THE INVENTION

Figure 1:
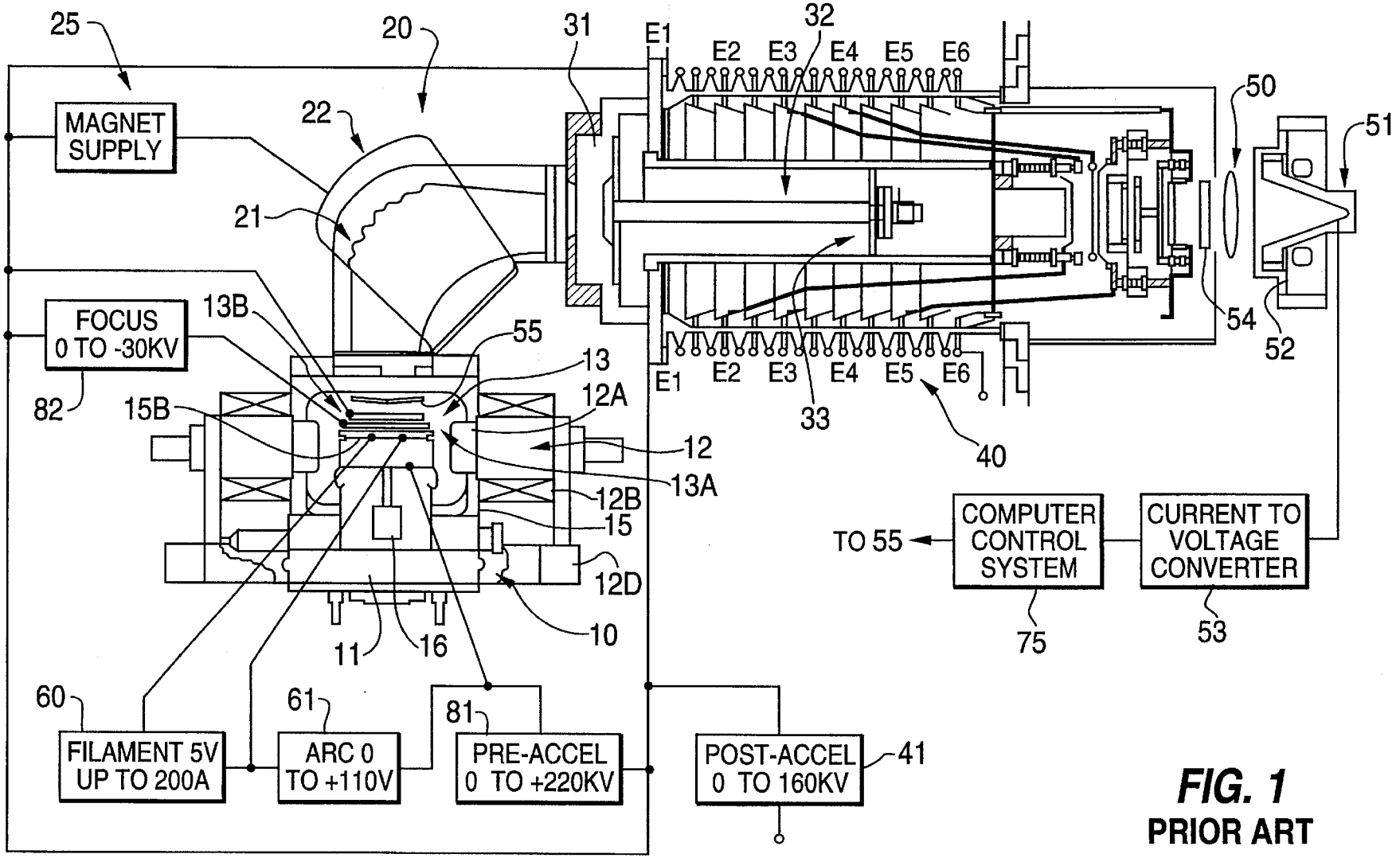
FIG. 1 PRIOR ART
FIG. 1 is a partial sectional view of a prior art ion implanter beam line which is the preferred system environment for the ion source system and method of this invention.
Figure 1A:
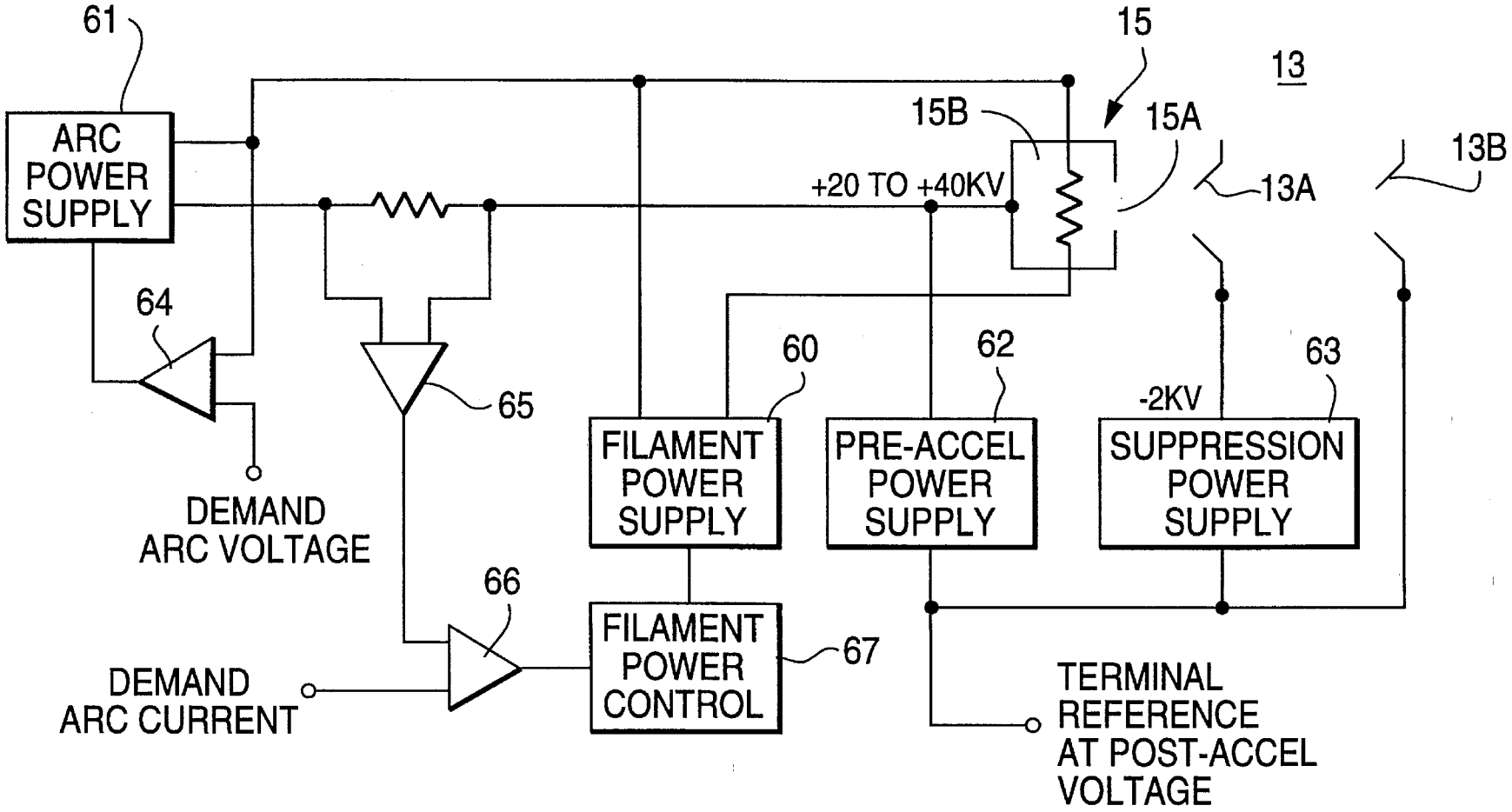
FIG. 1A PRIOR ART
FIG. 1A is a schematic diagram of an ion source control and ion beam extraction system.

As an aid to understanding the present invention, reference is had to FIGS. 1 and 1A which illustrate a state-of-the-art Freeman-type ion implanter apparatus. Ions are generated in the arc chamber 15 of a Freeman ion source. An extraction electrode assembly 13 extracts a beam of ions through a rectangular exit aperture 15A in the front of the arc chamber 15. The ion beam is both extracted and accelerated toward the mass analyzing system 20, which includes an ion beam flight tube 21 providing a path between the poles of an analyzing magnet assembly 22. The ion beam is bent in passing through the analyzing magnet assembly 22, enters an ion drift tube 32, passes through a mass resolving slit 33, is accelerated in a post acceleration system 40 and strikes a target element 50. During a portion of the scan cycle, the target element 50 is out of the beam, and all of the beam current falls on the beam stop 51. Suppression magnets 52 in the beam stop arrangement 51 produce a magnetic field oriented to prevent electrons arriving or leaving the beam stop and thus to ensure accurate measurement of the beam current generated.

Ion source assembly 11 includes a magnet assembly 12 which has separate electromagnets with cylindrical poles 12A having their axis aligned with the filament 15B within the arc chamber 15. The source magnets produce higher efficiency of ion generation by causing electrons emitted from the filament 15B to spiral around the filament in a path to the walls of the arc chamber 15 serving as the anode, and thus increase the ionization efficiency in the source.

As shown in FIG. 1A, the Freeman ion source is operated from an electrical standpoint by coupling a filament power supply 60 across the filament 15B to supply high current at low voltage to the filament. An arc power supply 61 applies a voltage, which is typically clamped to a maximum of about 120 volts between the filament 15B and the arc chamber 15, with the arc chamber 15 serving as an anode. Filament 15B generates thermal electrons which are accelerated through the gas species within the arc chamber and toward the arc chamber walls to create a plasma of the ion species within the arc chamber 15. The ion implant apparatus is more fully described in U.S. Pat. No. 4,754,200, incorporated herein by reference in its entirety.

Figure 2:
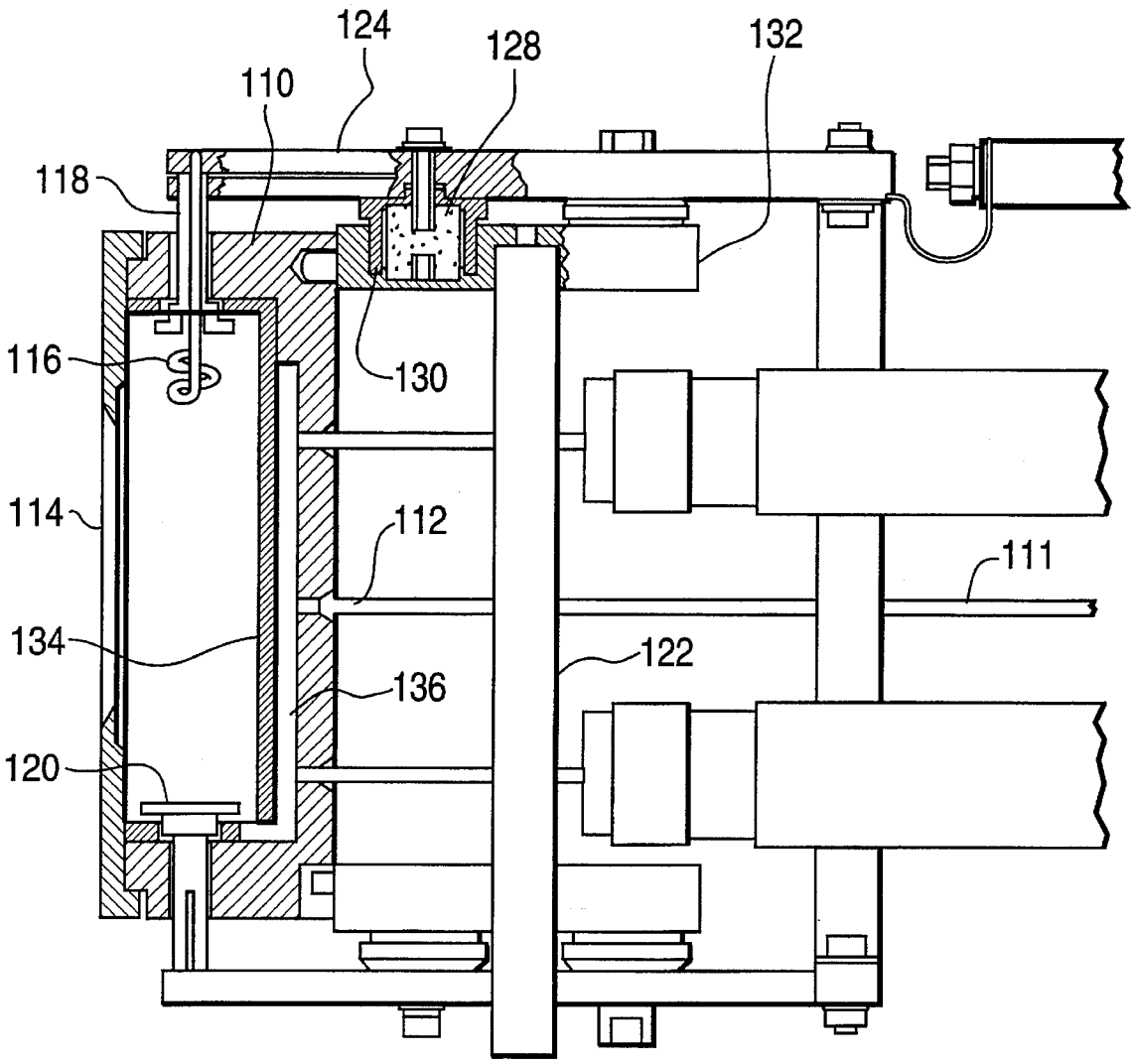
FIG. 2 is a side view of a Bernas ion source useful in the invention.

FIG. 2 is a side view of a Bernas-type ion source in accordance with the present invention. A Bernas source differs mainly from a conventional Freeman source in that the filament is in the form of a loop at one end of the arc chamber, rather than a rod-like filament which extends into the arc chamber. The present invention applies both to Bernas and to Freeman ion sources.

Figure 2A:
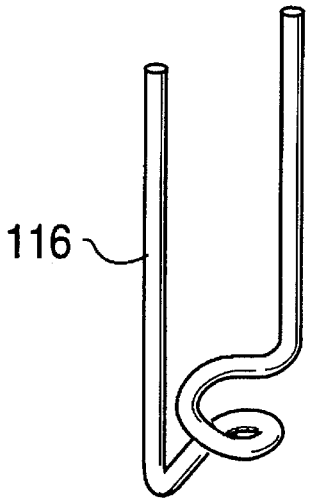
FIG. 2A is an enlarged side view of a Bernas-type filament.

Referring to FIG. 2, the ion arc chamber 110 is a nearly closed chamber having a gas inlet port 112. Gases, such as $BF_3$ or $SiF_4$, can be fed directly to the arc chamber 110 from a gas source indicated at 111. Vaporizable metal sources, such as antimony, arsenic or phosphorus, can be vaporized in a hot oven and then passed into the arc chamber 110. The arc chamber 110 is also fitted with an exit aperture 114 through which the ion beam generated in the arc chamber 110 exits, is focussed and is accelerated to the desired target. A coiled filament 116 is situate at one end of the arc chamber 110. An enlarged view of the filament 116 is shown in FIG. 2A. An electron reflector 118, suitably made of molybdenum, tungsten or other suitable refractory material, and preferably of tungsten, surrounds the filament 116 and serves to reflect the electrons generated in the arc chamber 110 away from the filament end of the arc chamber 110. The reflectors 118 are at the same potential as the filament 116. There is a small gap between the reflector 118 and the arc chamber 110. Careful design of the reflector/arc chamber mount ensures that the gap between them is maintained so that the reflectors 118 do not contact the arc chamber 110 and liner 134, which would cause a short circuit. However, the clearance is kept small to avoid loss of processing gas from the arc chamber 110. A refractory electron reflector 120 is placed at the other end of the arc chamber; it too must not contact the arc chamber 110, for the same reason. For a Freeman source, the filament would pass through both ends of the chamber 110 and through both of the reflectors 118.

The filament 116 is mounted on the body 122 of the source by means of a clamp 124, which will be described in more detail hereinbelow.

Outside the arc chamber 110 and mounted below the clamp 124 is insulator 128. The insulator 128, now entirely outside of the arc chamber 110, supports the filament/reflector assembly and in turn is surrounded by a shield 130 that acts to prevent any gas molecules from the arc chamber 110 from reaching the insulators 128. The insulators 128 are recessed in a plate 132 on the body 122 of the ion source.

The insulators are made of a high temperature ceramic material such as boron nitride, or aluminum oxide and electrically insulate the filament within the arc chamber 110.

Figure 3:
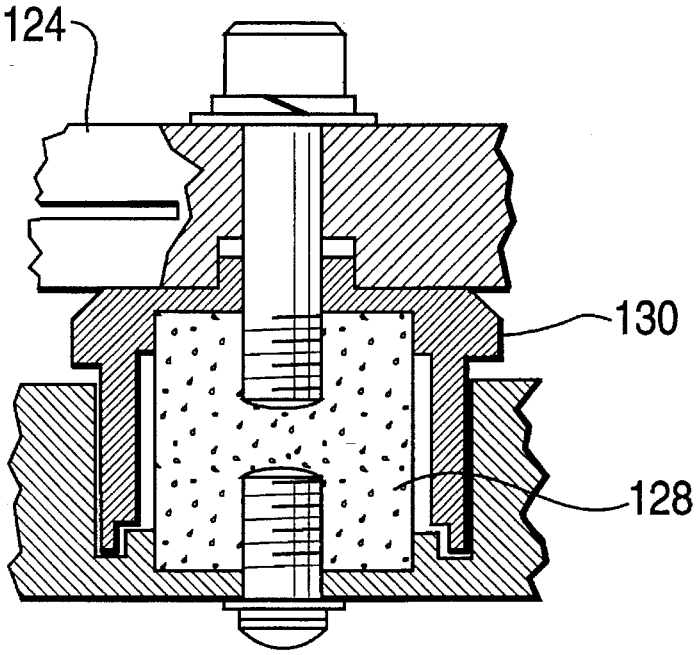
FIG. 3 is an enlarged view of the insulator/shield assembly mounted outside of the ion source chamber.

FIG. 3 is an enlarged, more detailed view of the insulator/shield assembly 128/130 of the invention wherein the same numerals are used for the same parts as for FIG. 2.

The insulators 128 can be further protected from gaseous species that are emitted from the arc chamber 110 by one or more shields 130 that form a labyrinth around the insulators 128. This labyrinth further protects the electrical insulators 128 because gaseous species must make several collisions with various walls of the labyrinth prior to being able to reach the insulators 128. The more surfaces there are around the insulators 128, the more likely that any gaseous species from the arc chamber 110 will coalesce and condense before reaching the insulators 128. The shield 130 can be made of a metal such as stainless steel.

A further method of protecting the electrical insulators 128 is an inert gas bleed flowing over the insulators 128, again to prevent gaseous ion species from reaching the insulators 128. An inert gas cloud around the insulators 128 acts as a further barrier to prevent diffusion of any gaseous ions towards the insulators 128.

To increase the protection of electrical insulators 128 located outside of the arc chamber 110, one or both of the shield means 130 and an inert gas barrier means (not shown) can be utilized, but preferably both will be employed.

To further enhance the ionization efficiency of the present arc chamber 110, a removable, thermally isolating liner 134 can be placed inside the arc chamber 110.

The liner 134 only actually contacts the arc chamber 110 in a very few places, and thus the bulk of the liner 134 is separated from the chamber walls 136 by a gap of about 0.1 mm. Thus as the liner 134 heats up as power is fed to the filament 116 and the plasma, this heat is transferred to the walls 136 of the arc chamber 110 by radiation. The walls of the arc chamber 110 then become hotter than a conventional arc chamber. The raised electron temperature in the arc chamber 110 in turn increases the ionization efficiency of the ion source.

The efficiency of an ion source is the fraction of the input material (precursor gases) to the ion source that is ionized and extracted from the source. The higher this efficiency, the less material that is required to produce a given extracted current or ion beam. Thus, increasing the ionization efficiency has several advantages; it reduces the amount of gaseous ion source material needed to be fed to the arc chamber 110; and it reduces the vacuum levels required to be used, with a concomitant reduction in unwanted or undesirable ion species generated. This also reduces the total available gaseous species that can coat or condense either within or outside the arc chamber itself.

The liner 134 herein is preferably made of tungsten. The material of the liner is important because of the danger of contamination of the target or substrate being ion implanted by the liner molecules or ions. As an example, $Mo^{2+}$ (MW 98) cannot be resolved from dopant source ions $BF_2$ (MW 49), and thus cannot be isolated from this dopant ion during mass resolution, and will be transmitted as a contaminant during ion implantation by boron. As another example, reaction of a carbon arc chamber with plasma fluorine atoms produces CF (MW 31) and $CF_2$ (MW 50) ions, masses similar to popular dopants such as P (MW 31) and $BF_2$ (MW 50). These carbon fluoride ions are not completely separable from the dopant ions and thus are contaminants in the ion implantation of boron and phosphorus as well.

Figure 6:
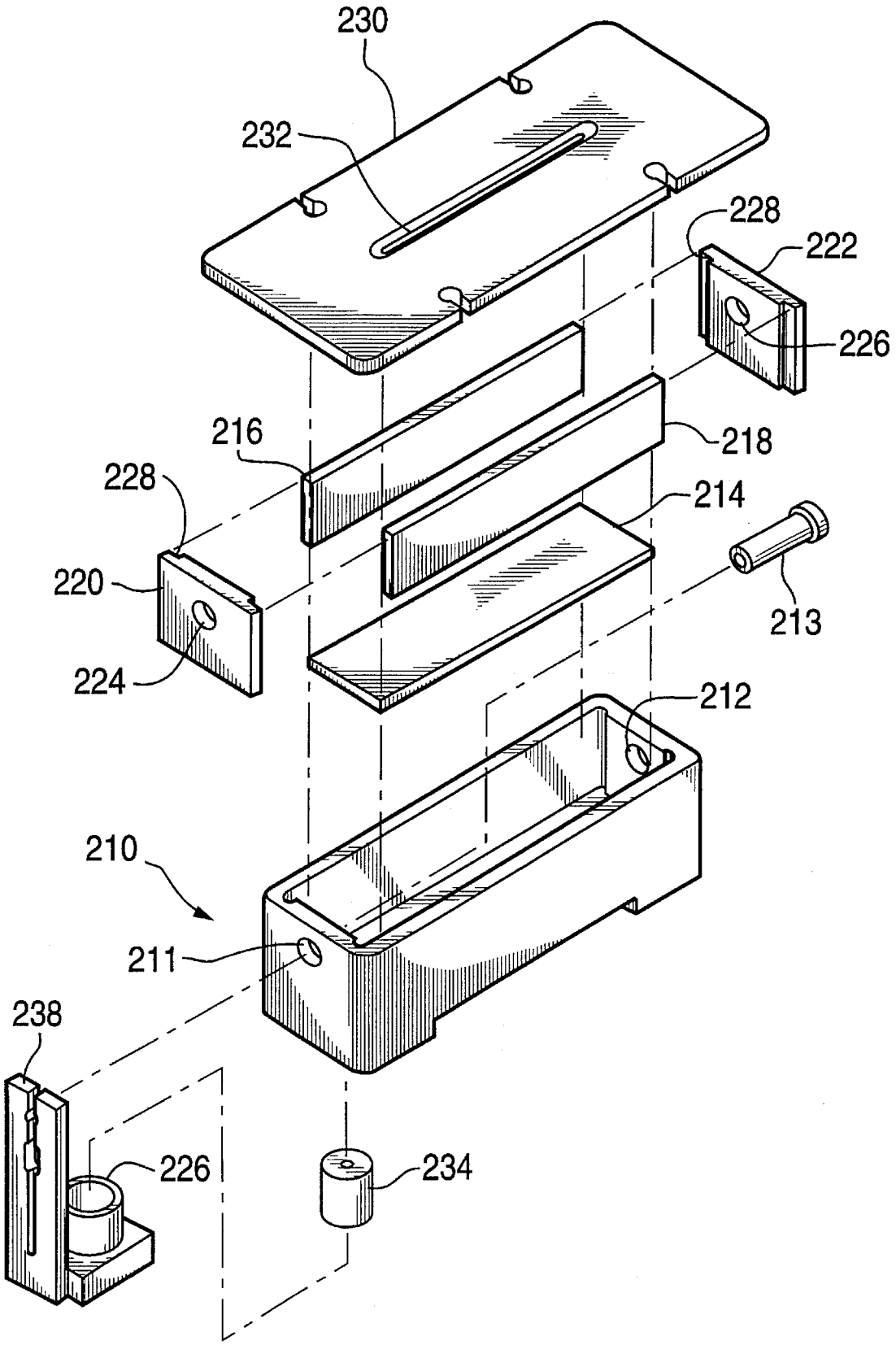
FIG. 6 is an exploded view of a lined Freeman-style arc chamber of the invention.

FIG. 6 is an exploded view of a Freeman-type arc chamber 210 of the invention that is completely lined with liner plates made of tungsten. The arc chamber 210 has openings 211 and 212 for passage therethrough of a filament (not shown) and filament guide 213. A bottom liner plate 214 and two side plates 216 and 218 fit together with end plates 220 and 222. End plates 220 and 222 have openings 224 and 226 for passage therethrough of the filament and filament guide, and also have slots 228 formed therein so that the side plates 216 and 218 fit into the slots 228, interlocking the liner plates of the arc chamber 210. A front plate 230 has an exit aperture 232 therethrough which acts as an extraction slot for the ion beam. The insulator 234 of the invention, the shield 236 of the invention and filament guide clamp 238 of the invention have been discussed hereinabove and perform the same functions here. Preferably the liner plates, the front plate of the arc chamber, the filament guide clamp and the insulators are all made of tungsten.

The use of a tungsten liner is preferred because it will not contaminate the wafer or other substrate to be ion implanted. In fact, during our work on tungsten liners, it was realized that the same advantages of reduced contamination of the implant by liner materials is equally valid and applicable to the material of the arc chamber itself, and indeed all parts of the chamber in contact with the plasma. Generally heretofore arc chambers have been made of carbon and/or molybdenum, which, as has been explained hereinabove, have the problem of generating ion species which contaminates various ion implants, such as of boron or of phosphorus, with $Mo^{+2}$ and CF and $CF_2$ for example. Thus, by making the arc chamber itself of tungsten, or portions of the arc chamber, as for example the wall having the exit aperture therein, whether or not a liner is used, and whether or not a tungsten liner is used, will reduce contamination of ion implants by the materials within the arc chamber. Other parts such as the reflectors for the filament can also be advantageously made of tungsten. This is true whether or not the insulators are within or outside of the arc chamber, as detailed hereinabove. Thus the use of tungsten to make all or part of the arc chamber, or parts such as reflectors within the arc chamber, whether in a conventional ion implant apparatus or the present ion implant apparatus is thus also contemplated herein.

Although some materials may deposit on the liner 134 during operation of the arc chamber 110, they do not interfere with operation of the filament 116.

In the case of highly toxic and corrosive input precursor gases such as $SiF_4$ and $BF_3$, it is highly desirable to reduce the total amount of gases required, and thereby reduce the required vacuum level in the system. The vacuum related problems, such as collisions with natural gas species that result in unwanted ion species in the ion beam, and the resultant implantation of unwanted species, are reduced. When a solid source, such as arsenic, is the input to the ion source, its vaporization rate can be reduced, the total amount of vaporized metal used will be reduced and therefore the danger of condensation of the solid metal onto surfaces outside the arc chamber are also reduced. This in turn reduces other sources of ion beam instabilities and increases the time period between required oven refills.

Another advantage is that a higher level of desirable ions are produced at higher temperatures, and thus the higher wall temperature enhances the output of certain ion species. For example, the ratio of the desired $B_{11}$ ion formation to undesirable ion formation such as $BF_2$, is increased from about 1.5:1 to about 2:1. This is a startling improvement in ion efficiency.

The apparatus of the invention greatly increases the time for forming a conductive coating on the electrical insulators, thereby extending the lifetime of the ion source by a factor of from 2–4, and similarly reducing the downtime of ion implantation equipment. Since the liner 134 is removable, it can be replaced during servicing of the arc chamber as desired. A reduction in the number of times an ion source must be serviced not only increases the time between services, but also lessens the opportunity for faulty re-assembly, another cause of ion implant apparatus failure.

Figure 4:
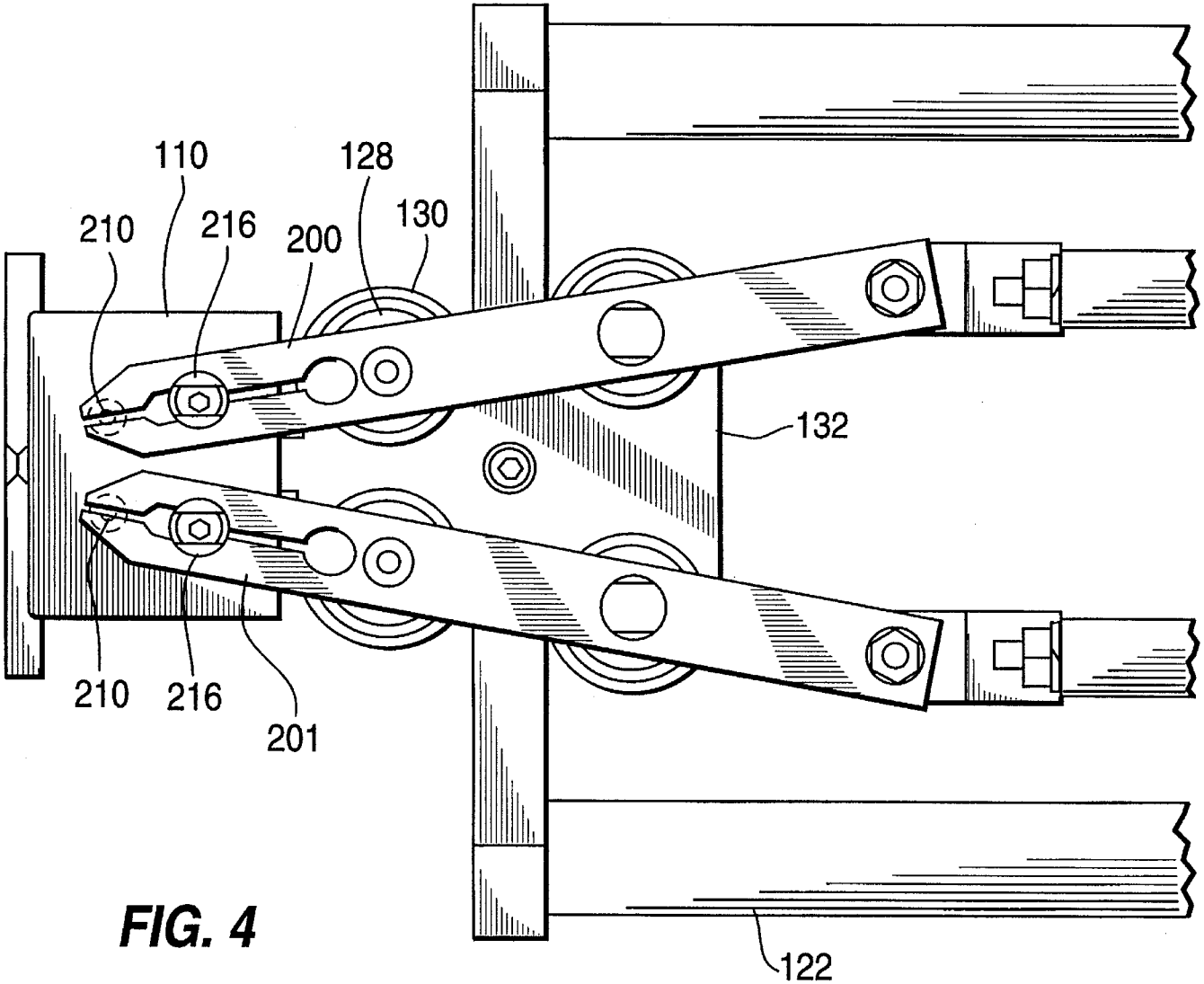
FIG. 4 is a top view of a pair of four-jaw unitary clamps useful herein to grip a Bernas-type filament.
Figure 5:
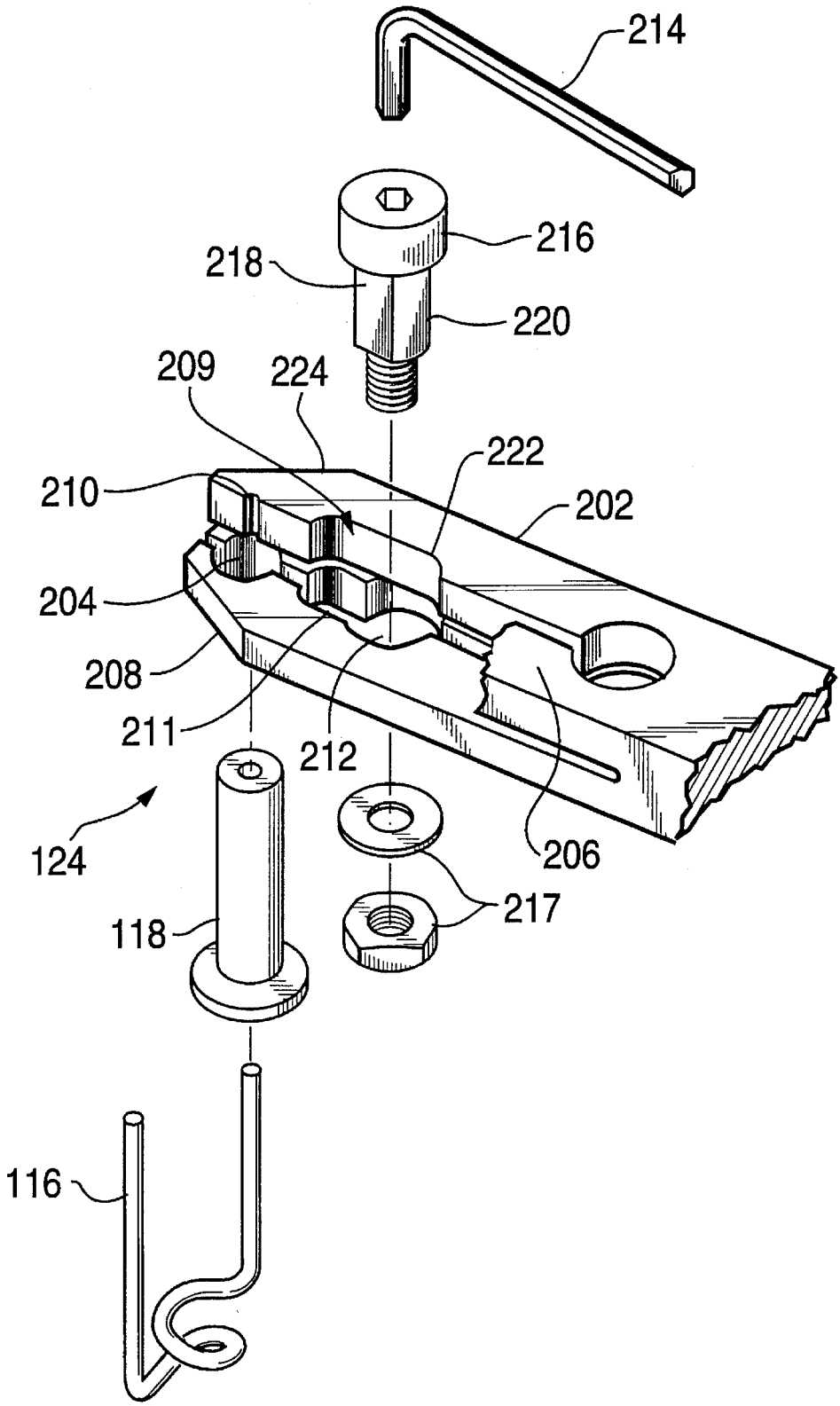
FIG. 5 is an exploded view of a clamp system of FIG. 4.

The serviceability of ion implanters is also improved by the use of a bifunctional filament clamp, shown in FIGS. 4 and 5. FIG. 4 is a top view of a pair of clamps 200 and 201 useful to clamp both ends of a Bernas-type filament along with its appropriate reflectors.

In the case of a Freeman source, separate clamps are used for engaging the filament and reflector/filament guides. The latter still has the dual functions of clamping the filament guide and providing a shield for the insulator. Both clamps should be made of preferably of tungsten and can be made of molybdenum if contamination is not a problem.

Referring to FIG. 5 which is an expanded view of the clamp system 124, each clamp 200 and 201 engages both the filament 116 and the filament reflectors or guides 118 at the same time and maintains their relative alignment. Each clamp 200, 201 has four jaws, 202, 204, 206 and 208 in one unitary assembly fitted with a straight slot 209 in the top pair of jaws 202/206. The upper jaws 202, 206 have a smaller aperture 210 for clamping one end of the filament 116. The lower jaws 204, 208 have a keyhole slot 211 and a larger aperture 212 for clamping each reflector 118. The jaws 202 and 206 which grip one end of the filament 116 can be opened separately to facilitate a filament change, or both pairs of jaws 202/206 and 204/208 can be opened together, by means of an allen key 214.

The allen key 214 is inserted into a screw 216 having two flat sides 218 and two curved sides 220 inserted into the clamp 200 and fastened by means of a washer and nut 217. If only the filament 116 is to be clamped, the screw 216 is slid into first position 222. As the screw 216 is rotated one-quarter turn, the jaws 202/206 will be forced open by the larger curved face 220 of the screw 216. This operation is repeated with clamp 201, see FIG. 4. The filament 116 can now be removed and serviced or replaced. To clamp the new filament 116 in place, the screw 216 is turned an additional one-quarter turn when each clamp 200 and 201 will tighten again to retain the replacement filament 116.

If both the filament 116 and the reflectors 118 around them are to be removed or replaced, the screw 216 is slid into a second position 224. A quarter turn of the screw 216 will open both sets of jaws 202/206 and 204/208, releasing both the filament 116 and the reflectors 118. After replacement, the screw 216 is turned a quarter turn again, clamping both filament 116 and reflectors 118 together and maintaining their alignment.

This clamp system 124 enables a more efficient removal of the filament and reflector during servicing of the ion source chamber. Down time is reduced, and the filament and filament reflector can be handled as a unit, thereby permitting faster replacement of the equipment, and reducing the danger of misalignment of the filament and filament reflector or guides during re-assembly.

The modifications to ion implanters described in the present invention extend the lifetime of the ion source, requires much less down time for the equipment, and eliminates causes of misalignment of the filament and filament reflectors, further reducing the down time. The use of a removable liner for the arc chamber increases the ionization efficiency and, depending on the materials used, can reduce the contamination of the ion beam.

Although various examples of the system and method of the invention have been disclosed above, they have been presented by way of illustration only. Numerous changes and variations will be apparent to one skilled in the art and are meant to be included herein without departing from the scope of the invention as claimed in the following claims.

We claim:

1. A filament system for emitting electrons in an arc chamber having two ends connected to a source of current outside of said arc chamber, said chamber including walls enclosing a filament for said arc chamber, comprising at least one electron reflector made of a refractory material surrounding said filament, said reflector being at the same potential as said filament, and said reflector mounted so as to maintain an insulating gap with respect to the walls of said arc chamber wherein the filament is a Bernas-type filament.

2. A filament system according to claim 1 wherein said reflector is made of tungsten.

3. A filament system according to claim 1 wherein a second reflector is mounted opposite to said filament so as to maintain a gap with respect to the walls of said arc chamber.

4. A filament system according to claim 1 wherein said filament is mounted on a source body outside of said arc chamber.

5. A filament system according to claim 1 wherein said filament is mounted on a source body outside of said arc chamber by means of a unitary clamp having two sets of clamp jaws, one set engageable with the ends of said filament and the second set engageable with said one or more reflectors.

6. A filament system according to claim 5 wherein said clamp is made of tungsten.

7. A filament system according to claim 1 additionally including electrical insulators for said filament mounted onto a source body outside of said arc chamber.

8. A filament system according to claim 7 wherein said insulators are made of a ceramic insulator material.

9. A filament system according to claim 8 wherein said insulators are made of boron nitride or aluminum oxide.

10. A filament system according to claim 7 wherein said insulators have a surrounding shield means to prevent gas molecules from said arc chamber from reaching said insulators.

11. A filament system according to claim 10 wherein said shield means is a cloud of inert gas molecules.

12. A filament system according to claim 10 wherein said shield means is in the form of a labyrinth.

13. A filament system according to claim 10 wherein said shield means includes both a cloud of inert gas molecules and a plurality of shield walls in the form of a labyrinth.

14. A filament system for emitting electrons in an arc chamber having two ends connected to a source of current outside of said arc chamber, said chamber including walls enclosing a filament for said arc chamber, comprising at least one electron reflector made of a refractory material surrounding said filament, said reflector being at the same potential as said filament, and said reflector mounted so as to maintain an insulating gap with respect to the walls of said arc chamber wherein the filament is a Freeman-type filament.

15. A filament system according to claim 14 wherein said reflector is made of tungsten.

16. A filament system according to claim 14 wherein a second reflector is mounted opposite to said filament so as to maintain a gap with respect to the walls of said arc chamber.

17. A filament system according to claim 14 wherein said filament is mounted on a source body outside of said arc chamber.

* * * * *